US007331313B2

(12) United States Patent
Weissinger et al.

(10) Patent No.: US 7,331,313 B2
(45) Date of Patent: Feb. 19, 2008

(54) CONTINUOUS STEAM GENERATOR WITH CIRCULATING ATMOSPHERIC FLUIDISED-BED COMBUSTION

(75) Inventors: Gerhard Weissinger, Köngen (DE); Georg-Nikolaus Stamatelopoulos, Stuttgart (DE); Günter Trautmann, Winnenden (DE)

(73) Assignee: Alstom Power Boiler GmbH, Stuttgart (DE)

( * ) Notice: Subject to any disclaimer, the term of this patent is extended or adjusted under 35 U.S.C. 154(b) by 36 days.

(21) Appl. No.: 10/535,810

(22) PCT Filed: Nov. 18, 2003

(86) PCT No.: PCT/DE03/03808

§ 371 (c)(1),
(2), (4) Date: Oct. 11, 2005

(87) PCT Pub. No.: WO2004/048848

PCT Pub. Date: Jun. 10, 2004

(65) Prior Publication Data

US 2006/0124077 A1 Jun. 15, 2006

(30) Foreign Application Priority Data

Nov. 22, 2002 (DE) ..... 102 54 780

(51) Int. Cl.
*F22D 1/08* (2006.01)
*F22D 1/04* (2006.01)

(52) U.S. Cl. ..... 122/406.1; 122/4 D

(58) Field of Classification Search ..... None
See application file for complete search history.

(56) References Cited

U.S. PATENT DOCUMENTS 2,997,031 A 8/1961 Ulmer (Continued)

FOREIGN PATENT DOCUMENTS

DE 35 25 676 A1 1/1987

(Continued)

OTHER PUBLICATIONS

International Search Report PCT/DE 03/03808 dated May 28, 2004.

(Continued)

*Primary Examiner*—Gregory Wilson
(74) *Attorney, Agent, or Firm*—Alix, Yale & Ristas, LLP

(57) ABSTRACT

A continuous steam generator with a circulating atmospheric fludized-bed chamber is defined by encircling walls essentially on all sides, comprised of gas-permeable tubular walls provided with essentially vertical tubes, and comprises at least one funnel in its lower region. The turbulence combustion chamber has at one essentially vertically arranged heating surface provided with vertical tubes, said heating surface comprises of a welded tube-web-tube combination, and a water/steam working medium flows through the tubes of the encircling walls and the heating surface. All of the tubes of the encircling walls and the heating surface are embodied as evaporator heating surfaces and are mounted in parallel for the circulation of the entire working medium to be evaporated. In addition, all of the tubes of the encircling walls have an inner smooth surface, and the heating surface extends between the bottom of the combustion chamber or the upper edge of the funnel, and the top of the combustion chamber.

20 Claims, 6 Drawing Sheets

U.S. PATENT DOCUMENTS

| | | | | |
|---|---|---|---|---|
| 3,893,426 | A * | 7/1975 | Bryers | 122/4 D |
| 4,544,020 | A | 10/1985 | Chrysostome et al. | |
| 5,034,197 | A * | 7/1991 | Potinkara | 422/146 |
| 5,069,171 | A * | 12/1991 | Hansen et al. | 122/4 D |
| 5,513,599 | A * | 5/1996 | Nagato et al. | 122/4 D |
| 5,537,941 | A * | 7/1996 | Goidich | 110/348 |
| 6,470,833 | B1 | 10/2002 | Hyppänen | 122/4 D |
| 6,715,450 | B1 * | 4/2004 | Wittchow | 122/1 B |

FOREIGN PATENT DOCUMENTS

| | | |
|---|---|---|
| DE | 694 04 423 T2 | 7/1997 |
| EP | 0 882 872 A2 | 12/1998 |
| EP | 1 030 150 A1 | 8/2000 |

OTHER PUBLICATIONS

German Search Report dated Oct. 27. 2003.
International Search Report PCT/DE 03/03808.

* cited by examiner

CONTINUOUS STEAM GENERATOR WITH CIRCULATING ATMOSPHERIC FLUIDISED-BED COMBUSTION

BACKGROUND OF THE INVENTION

The invention relates to a continuous steam generator having a circulating atmospheric fluidized-bed firing system.

SUMMARY OF THE INVENTION

Briefly stated, the invention in a preferred form is a continuous steam generator having a circulating atmospheric fluidized-bed firing system having a fluidized-bed combustion chamber in which the fluidized-bed combustion chamber is essentially defined on all sides by enclosing walls having gas-tight tubular walls essentially comprising vertical tubes and in the lower area at least one funnel. The fluidized-bed combustion chamber is embodied with at least one essentially vertically disposed heating surface equipped with vertical tubes whereby the heating surface is comprised of a welded tube-web-tube combination. The tubes of the enclosing walls and the heating surface have a water/steam working medium passing through them wherein all the tubes of the enclosing walls and the heating surface are configured as an evaporator heating surface and they are connected in parallel so that all of the working medium that is to be evaporated can pass through them. All tubes of the enclosing walls are configured with a tube surface area that is smooth on the inside and the heating surface extends between the bottom of the combustion chamber or the top of the funnel edge and the combustion chamber cover.

The flow of working media through the tubes of the enclosing walls and of the heating surface is accomplished without the aid of intermediate collectors. The heating surface can be heated on both sides. The inner surfaces of the tubes of the heating surface have a single- or multiple-pitched helical internal ribbing. The heating surface is configured so that it can be heated from one side. The inner surfaces of the tubes of the heating surface have a smooth surface. The heating surface has a box-shaped cross section with a width and a depth and on the peripheral side comprises an inner space that is enclosed about its circumference. The cross-section of the box-shaped heating surface can be configured to have at least three corners or to be round. The cross-section of the box-shaped heating surface can be configured to be rectangular.

The box-shaped heating surface which is provided with a fire-proof covering in the combustion chamber funnel area is bent out into the area of the inner space in the transition area between the covered and uncovered heating surface area and the front edges of the fire-proof covering and of the uncovered area of the heating surface are configured so that they align in the vertical direction. The tubes of the enclosing walls essentially can have equal heated lengths. The tubes of the heating surface essentially can have the same heated links as the tubes of the surrounding walls.

In recent years, continuous steam generators having circulating fluidized-bed firing systems (CFBFSs) have been designed. As is the case with all power plant systems fired by fossil fuels, an attempt is made to reduce the emissions resulted from combustion in order to protect the environment. This can be done by increasing the power plant's process efficiency combined with a reduction in the amount of fossil fuel used. A portion of the increase in efficiency is accomplished by generating steam at high steam parameters (high steam pressures and temperatures). In order for the power plant units to operate efficiently within a wide load range, the steam generators are operating with sliding pressure. In order to meet various requirements (a constant high steam temperature, sliding steam pressure, rapid rates of load changes), only the forced continuous steam generating systems referred to above may be used.

For reasons relating to erosion, the combustion chamber-enclosing walls of continuous steam generators having circulating fluidized-bed firing systems cannot be positioned at a slope or angle, as is the case with conventional coal-dust-fired continuous steam generators, but rather they must have vertical tubes. Therefore, the circulating fluidized-bed firing systems were mainly combined with evaporator systems that work on the principle of natural circulation or forced circulation operation and are therefore equipped with vertically tubular enclosing walls. A small number of circulating fluidized-bed firing systems also generate steam by means of forced-circulation systems, however as a downcoming/riser pipe system with low vapor pressures (for example, the Moabit power plant). Plans have already been made for using CFBFSs-equipped forced continuous steam generators in the pressure range from 100 to 300 bar so that they will operate more efficiently—in other words, with less fuel. Because of the necessity of forming combustion chamber-enclosing walls from vertical evaporator tubes, tubes that have ribs on their inner sides were proposed for cooling the evaporator walls (see publication cited above).

In the transition from naturally circulating steam generators to (supercritical) forced continuous steam generations operating at high steam parameters (typically 250 to 300 bar, 560 to 620° C.) in the power range from 300 to 600 MWel, the following problems and disadvantages occur in the prior art:

- CFBFSs continuous steam generators that are operated with sub-critical steam pressures use more fuel in comparison with supercritical steam pressures with the same steam generator output, therefore causing more hazardous emissions.
- In contrast to sloped tubes, vertical-tube-equipped forced continuous steam generators have the disadvantage that the number of tubes with a given combustion chamber geometry is larger and that the mass flow density (which is a measure of working medium flow in kg per $m^2$ flow cross-sectional area and per second) decreases per tube. In order, nevertheless, to ensure that the tubes are adequately cooled, tubes having internal ribs are used, or the individual walls of the combustion chamber-enclosing walls have serial fluid flow.
- Distributing the entire evaporator flow to a plurality of walls connected in series has a number of disadvantages:
  1) The individual walls must be connected by means of downcoming tubes
  2) When the evaporator flow is redistributed, demixing processes occur (different steam contents), which manifest themselves at the evaporator outlet as temperature aberrations, which can result in cracks in the walls as a result of thermal expansion being prevented.
  3) Higher pressure loss because of higher mass flow density.
- Tubes with internal ribs have higher pressure losses due to friction and have the disadvantage that special manufacturing techniques are required and that the effort and expense needed to join the part surfaces is greater.

The object of the invention is therefore to provide a continuous steam generator having a circulating atmospheric fluidized-bed firing system in which the aforesaid disadvantages are avoided and/or the following criteria are met.

- Use of more economical and more environmentally friendly continuous steam generators equipped with CFBFSs in the power range from approximately 300 to 600 MWel, and in a pressure range of approximately 100 to 300 bar.
- Achieving efficient combustion chamber design for such a continuous steam generator incorporating additional heating surfaces installed inside or, optionally, outside the combustion chamber.

The object of the invention referred to above is accomplished by the characterizing elements of patent Claim 1.

Preferred embodiments of the invention are found in the dependent claims.

The solution of the invention provides a continuous steam generator having a circulating atmospheric fluidized-bed firing system that has the following advantages:

- As a result of combining the combustion chamber-enclosing walls and additional heating surfaces located in the combustion chamber as evaporation heating surfaces and causing the working medium to flow through these evaporator heating surfaces in parallel, the fluidized-bed combustion chamber and, thus, also the continuous steam generator can be configured to be much lower in terms of its design scope and therefore to be more cost effective.
- There are economic advantages of using smooth tubes-in other words tubes that have smooth interior surfaces—in the enclosing walls of the continuous steam generator, since they are less expensive than internally-ribbed tubes and also since no specially manufactured parts are required. Numerous manufacturers produce a great variety of smooth tubes, which is not the case with internally-ribbed tubes.
- Using smooth tubes in the enclosing walls of the continuous steam generator results in a lower pressure loss in the evaporator heating surface compared to an evaporator heating surface made with tubes having internal ribs.
- The parallel flow of fluid through the enclosing walls and the additional heating surfaces disposed in the fluidized-bed chamber produce economic advantages, since it is not necessary to install intermediate collectors (blending or pressure-compensation collectors).
- Assembling the heating surfaces made from smooth tubes is more economical (no modification of the internal ribbing is necessary, thus less tubing wasted in assembly).
- The length or height of the vertical heating surfaces that are also located in the fluidized-bed combustion chamber is modified to match the height and construction (different funnels in the lower area of the combustion chamber) of the fluidized-bed combustion chamber. This leads to advantages in the assembly of the heating surfaces, since they can be efficiently integrated into the combustion chamber base or into the upper edge of the funnel, as well as the combustion chamber cover.
- The heating surfaces that are also located in the fluidized-bed combustion chambers can be designed as heating surfaces that are heated on one side and welded together to form boxes, or as bulkhead heating surfaces that are heated on two sides.
- The desired mass flow density that is necessary in order to compensate mass flow and heating differences and to achieve nearly the same outlet temperatures is accomplished through the integration of additional heating surfaces.
- The combustion chamber dimensions (cross section, height) and the integrated heating surfaces are dimensioned in such a way that the effective heat flow densities permit the use of vertical smooth pipes in the enclosing walls when mass flow densities are small.

As a result of the use of heating surfaces that are heated on both sides, said heating surfaces may be designed in a simple but advantageous manner by making flat bulkhead heating surfaces from a pipe-web-pipe combination. In a preferred embodiment the tubes of these bulkhead heating surfaces have an internal ribbing which, with lower mass flow densities and the higher heating (because the heating is two-sided) reliably cool the heating surfaces. In this case the tubes of the enclosing walls can remain smooth tubes.

In one preferred embodiment, the heating surface of the invention is heated on one side and the heating surface that is heated on one side is designed with smooth tubes in a preferred embodiment. In this way, as already described for the smooth tubes in the enclosing wall, an essential economic advantage is achieved, since smooth tubes are essentially less expensive, easier to install, and have a lower pressure loss due to friction.

In a preferred embodiment of the heating surface that is heated on one side, said heating surface is configured as a box-shaped heating surface having a box-shaped cross section. Because of the box-shaped design, the heating surface has a high degree of stability that permits combustion chambers of relatively large continuous steam generators be equipped with heating surfaces. In a further, preferred embodiment the cross section of the box-shaped heating surface is designed to be rectangular.

In order to achieve uniform heating of the working medium within the tubes in the enclosing walls, it is advantageous that said tubes essentially have the same heated length. In order to transfer the same effect to the tubes in the heating surfaces, it is also advantageous for the tubes in the heating surfaces to have the same heated length as the tubes in the enclosing walls.

Examples of the invention are explained in greater detail below on the basis of the drawing and the description.

In the continuous steam generators fired with fossil fuel in conventional power plants, in the prior art, the working medium, normally water/steam, is essentially preheated, vaporized, superheated, and optionally temporarily superheated in one pass through the steam turbine loop. The continuous steam generator including the appurtenant firing system is described below.

DETAILED DESCRIPTION OF THE PREFERRED EMBODIMENTS

Figure 1:
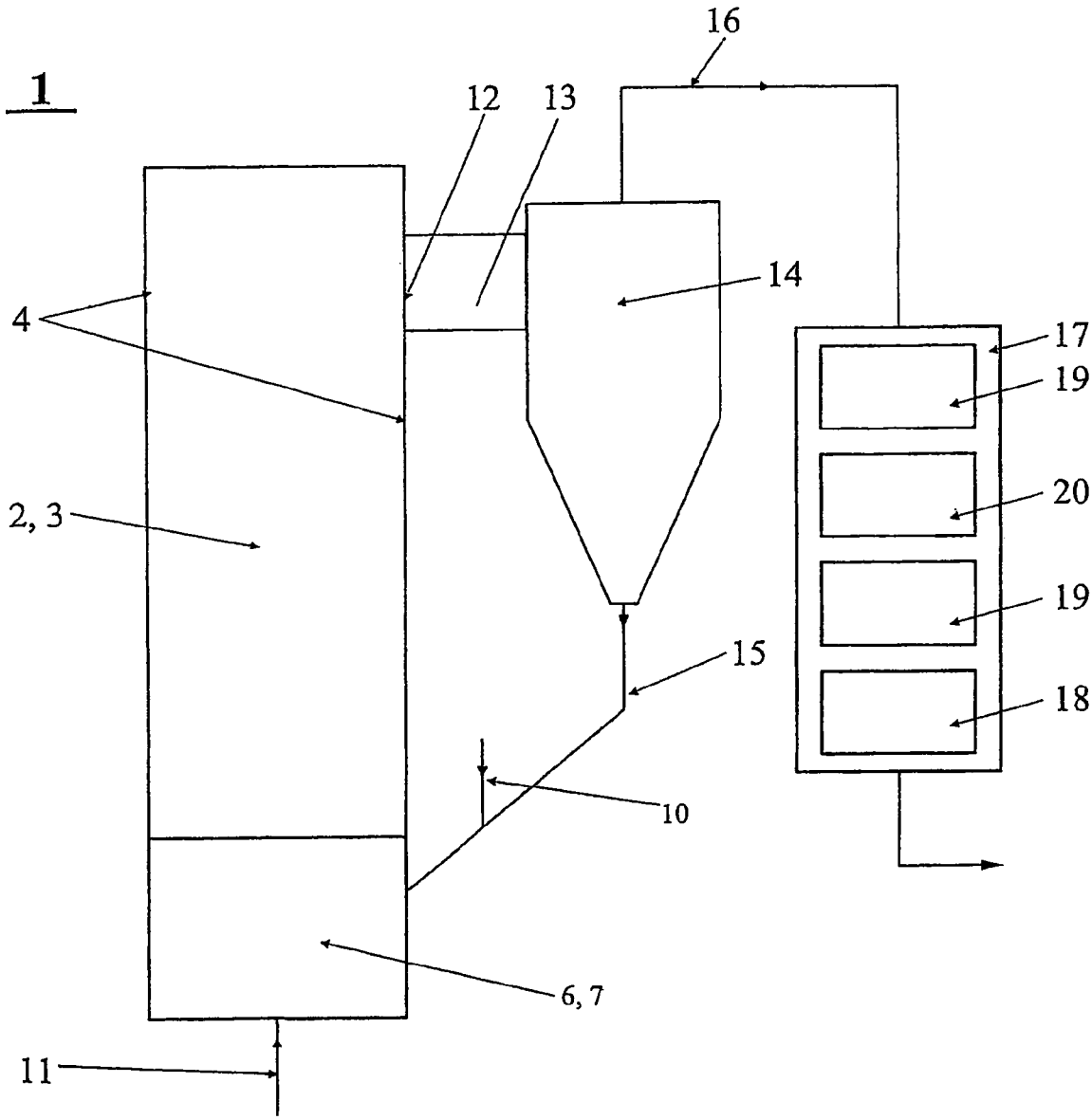
FIG. 1 a schematic diagram of a continuous steam generator having a circulating atmospheric fluidized-bed firing system in a longitudinal section, FIG. 2 a schematic diagram of a fluidized-bed combustion chamber of a fluidized-bed continuous steam generator having a combustion chamber funnel showing in a longitudinal cross section, FIG. 3 as in FIG. 2, a fluidized-bed combustion chamber having two combustion chamber funnels ("pant leg") shown in a longitudinal cross section, FIG. 4 schematic diagram of a combustion chamber of a fluidized-bed continuous steam generator (having one combustion chamber funnel shown in cross section per Section A-A, of FIG. 2, rotated by 90°, FIG. 5 schematic diagram of a combustion chamber of a fluidized-bed continuous steam generator (with two combustion chamber funnels) in the cross section indicated as Section B-B in FIG. 3, section rotated 90°, FIG. 6 schematic cross section of an alternative box-shaped heating surface (box bulkhead) of Detail C and FIGS. 4 and 5, FIG. 7 schematic diagram of a box-shaped heating surface with a vertically aligning transition from the fireproof exterior covering to the upper membrane tubular wall in a longitudinal section, corresponds to Section A-A in FIG. 8, FIG. 8 schematic cross section of a box-shaped heating surface shown in Section C-C of FIG. 9, FIG. 9 schematic longitudinal section of a box-shaped heating surface as shown in Section B-B of FIG. 8.

FIG. 1 shows a schematic diagram of a continuous steam generator 1 having a circulating fluidized-bed firing system 2 (CFBFS) for burning coal or other combustible materials. The material that is to be burned is transported through the feed line 10 into the fluidized-bed combustion chamber or fluidized-combustion chamber 3 of the continuous steam generator 1 having a CFBFS. In order to construct the fluidized-bed and to burn the material being fed in combustion chamber 3, a fluidization gas is directed through the feed line 11, normally the fluidized-combustion chamber 3. The fluidization gas is generally air, which therefore is used as the oxidizing agent for the combustion. The exhaust gas or flue gas that results from the combustion and the solids entrained by the exhaust gas (inert material, ash particles, and non-combusted materials) are transported out of the combustion chamber 3 in the upper area via opening 12, and they are fed via an exhaust gas line 13 to a precipitator, generally a centrifugal precipitator or cyclone precipitator 14. In the precipitator 14, the solids present in the exhaust gas are largely separating off and returned back to the combustion chamber 3 via the return line 15. The largely purified exhaust gas is fed via the exhaust gas line 16 to a second exhaust gas 17 stack in which at least one economizer heating surface 18, at least one superheater heating surface 19, and possibly at least one intermediate superheater surface 20 is provided for further use or for the acceptance of the exhaust gas heat. The cross section of combustion chamber 3 generally has a rectangular shape. However, it can also be round or have a different shape.

Figure 2:
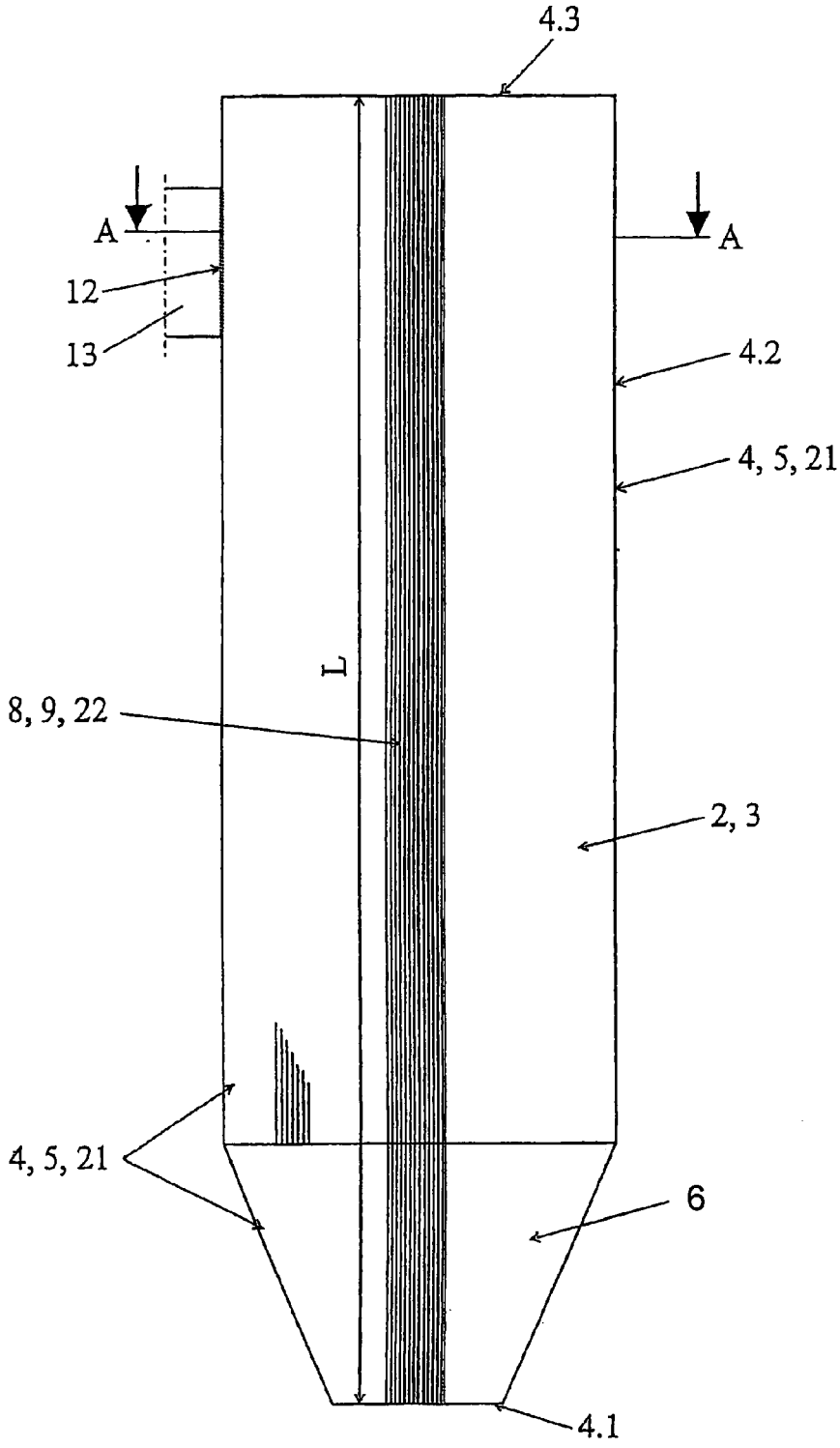
Figure 3:
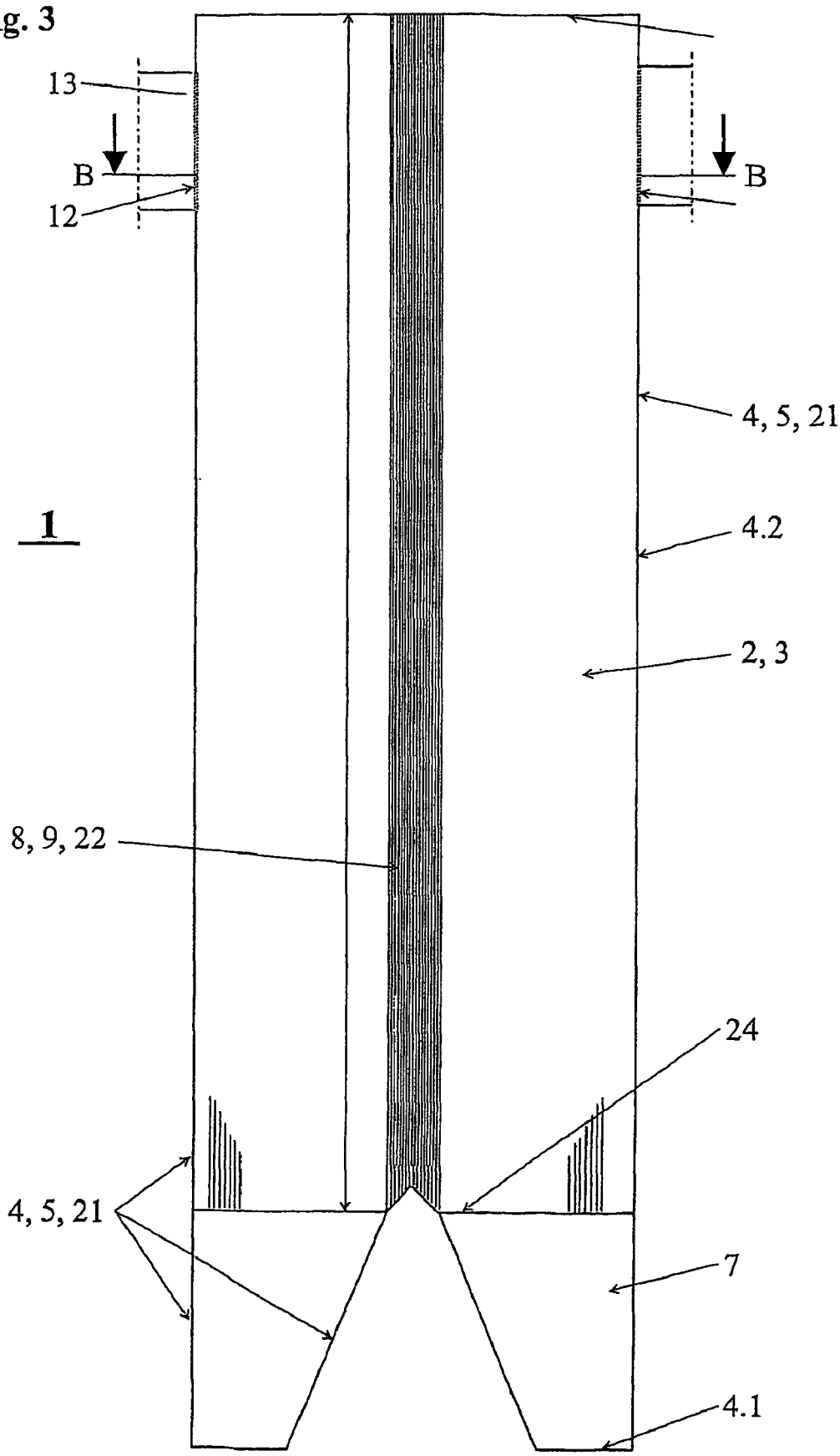
Figure 4:
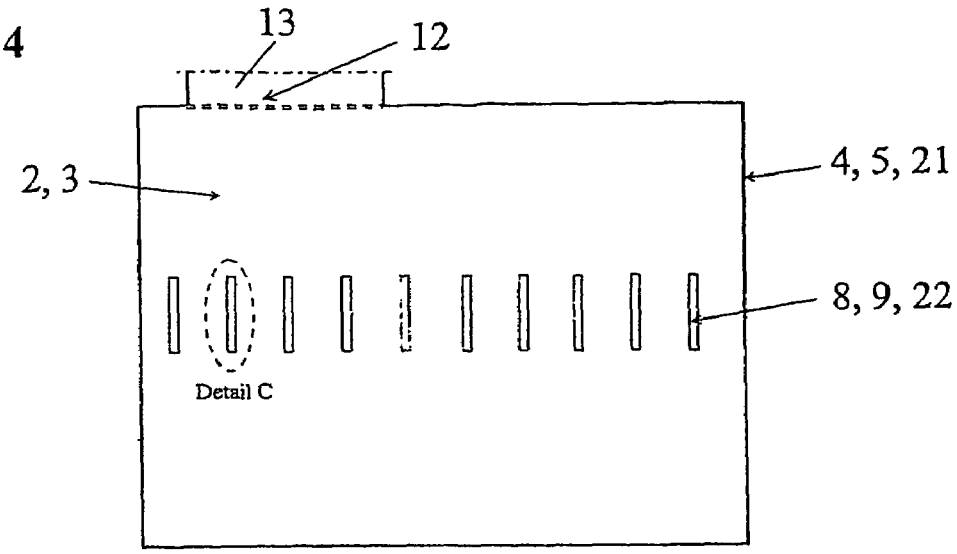
Figure 5:
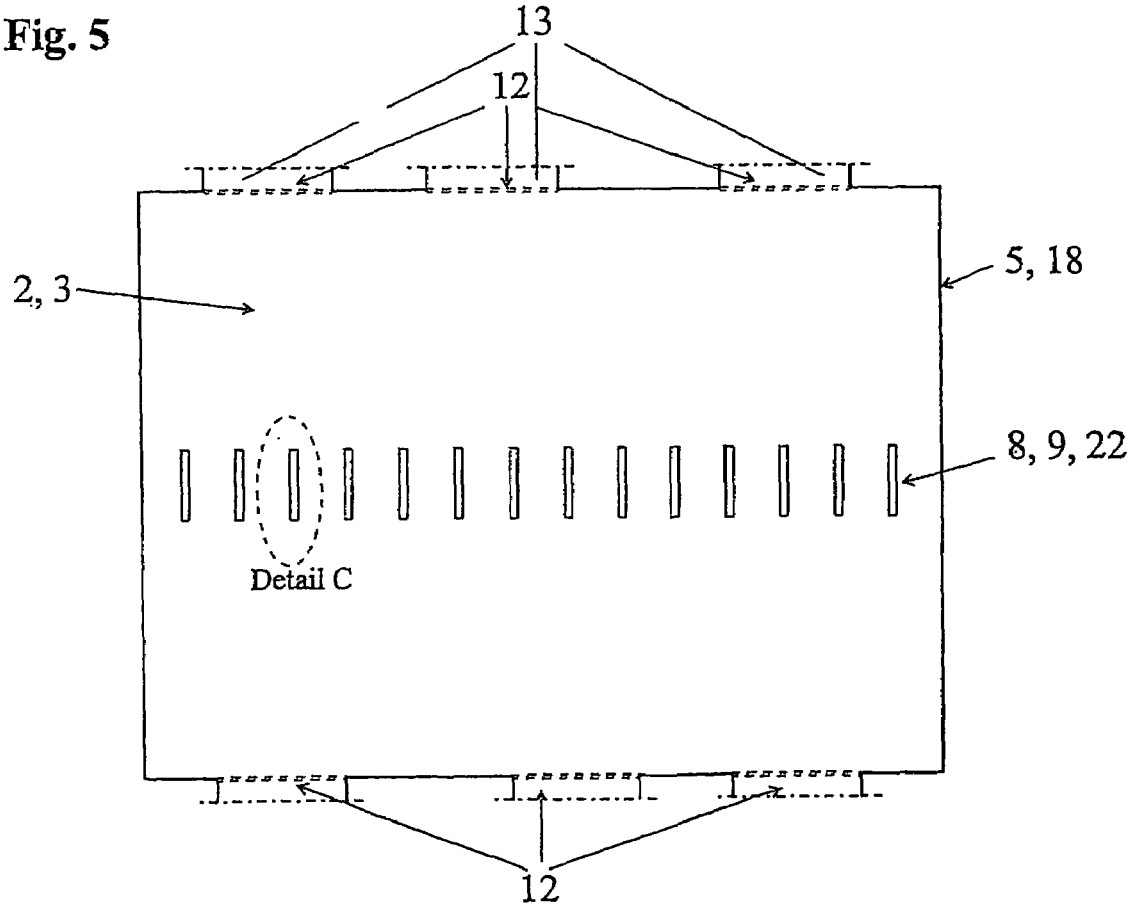

FIGS. 2 to 5 show in a longitudinal section as well as in a transverse section the rectangularly formed and essentially vertically disposed fluidized-bed chamber 3 of a continuous steam generator 1. The combustion chamber 3 is essentially enclosed on all sides by the enclosing walls 4, whereby the enclosing wall 4 seen from the bottom toward the top comprises the combustion chamber bottom 4.1, the combustion chamber side walls 4.2, and the combustion chamber top 4.3. The combustion chamber floor 4.1 is generally configured as a nozzle plate through which the fluidization gas is brought in. FIG. 2 shows a combustion chamber 3 having a simple funnel 6 in the lower area of the combustion chamber. On the other hand, FIG. 3 is a combustion chamber 3 having a dual funnel 7, a so-called "pant leg" design. The combustion chamber enclosing walls 4 are configured as heating surfaces through which the working medium flows, and said heating surfaces are made of gas-tight membrane walls. Such membrane walls can be assembled by means of gas-tight welding of a combination of tube-web-tube. As a rule, the tube-web-tube combination comprises tubes 5 whose exteriors are smooth and which are each connected by means of separate webs 21. However, it is also possible that finned tubes, whose outer wall is already equipped with webs and which are connected to each other, can be used.

The present invention relates to a continuous steam generator 1 having a circulating fluidized-bed firing system 2 characterized by a high output (approximately 300 to 600 MWel) and high steam parameters (about 250 to 300 bar pressure and 560 to 620° C.). In order to obtain an efficient combustion chamber design in this performance range, additional heating surfaces 8 must also be installed. For thermal technology reasons (uniform heat absorption) said additional heating surfaces 8 are preferably disposed within the combustion chamber 3.

The continuous steam generator 1 of the invention having a CFBFS 2 required that all tubes 5, 9 in the enclosing wall 4 and the heating surfaces 8 lying within combustion chamber 3 be embodied as an evaporator heating surface, and that they be connected in parallel for the flow of the entire working medium that is to be evaporated, that all tubes 5 in the enclosing walls 4 be equipped with a pipe surface area that is smooth on the inside, and that the heating surfaces 8 extend between the combustion chamber base 4.1 or funnel upper edge 24 and the combustion chamber cover 4.3. By connecting the heating surfaces 8 and the heating surface of the enclosing wall 4 of the continuous steam generator 1 in parallel, as well as by using both heating surfaces as an evaporator heating surface, one achieves the advantage that, by modifying the number of heating surfaces 8, the combustion chamber 3 can be designed to be efficient. In other words, using this measure, one is able to optimize the combustion chamber dimensions; above all the height of the combustion chamber (the distance between the bottom of the combustion chamber and the top), can be reduced significantly by including the heating surfaces 8. Additionally, the effective heat flux densities within the fluidized-bed combustion chamber 3 of the continuous steam generator 1 of the invention increase to permit tubes that have a smooth interior surface to be used for the tubes 5 of the enclosing walls 4 despite the reduced working medium mass flow densities of about 400 to 1200 $kg/m^2s$. Because of the reduced working medium mass flow densities, an improved natural circulation characteristic is achieved within the evaporator heating surface, which means that in the case of potential local excess heating, the working medium flow rate also increases here, so that safe tube cooling is ensured.

The use of tubes 5 having a smooth inner surface, also referred to for short as smooth tubes, has a number of advantages over tubes having inner ribs such as are used with low mass flow densities. For one thing, smooth tubes are significantly less expensive than internally ribbed tubes; moreover, they have shorter delivery times, can be supplied in substantially more different sizes, and are generally more available, since internally ribbed tubes usually are merely available as custom manufactured parts; furthermore, smooth pipes are significantly easier to deal with in assembly. Moreover, smooth tubes have a significantly lower working medium pressure loss due to friction compared with internally ribbed tubes, which has a positive effect on the uniform distribution of the working medium among the individual tubes 5, as well as a reduction of the feed pump capacity of continuous steam generator 1.

In order to increase the continuous steam generator process efficiency and, thus, to reduce the hazardous emissions that are caused by the steam generator firing system and that are released into the atmosphere, continuous steam generators 1 are being operated with increasing frequency in the supercritical range-in other words, at a steam pressure of over 220 bar as well as in sliding pressure between the supercritical and subcritical pressure (the operating pressure of the steam generator slides within the load range of the continuous steam generator—for example, between 20 to 100% load). In the case of a continuous steam generator operating pressure of, for example, 270 bar at full load, the steam generator reaches the critical pressure range at a partial load of about 70% and is operated subcritically below this partial load—in other words, in the partial load range roughly below 70% a 2-phase mixture occurs in the evaporator during the evaporating process. The solution in accordance with the invention referred to above ensures that within the vaporization heating surface (enclosing walls 4 and heating surfaces 8) no demixing of the steam and water occurs. This is further supported by the advantageous configuration-of the continuous steam generator 1 of the invention because the flow of working medium through tubes 5, 9 of the enclosing walls 4 and the heating surfaces 8 takes place without the assistance of intermediate collectors.

The additional heating surfaces 8 used in the fluidized-bed combustion chamber 3 are so-called bulkhead heating surfaces. Bulkhead heating surfaces are self-contained plate-like heating surfaces (in other words, the individual tubes 9 that are located next to each other are connected to each other by means of webs 22—a welded tube-web-tube combination—to form a bulkhead), in contrast to bundle-type heating surfaces, which are designed in an open configuration (in other words, the individual tubes located next to each other are not connected to each other by means of webs). The heating surfaces 8 are essentially disposed vertically within the combustion chamber 3, and the tubes 9 contained therein also extend in an essentially vertical direction.

In accordance with the invention, and depending on the combustion chamber design, the heating surfaces 8 either extend between the combustion chamber base 4.1 or between the upper edge of the funnel 24 and the combustion chamber cover 4.3. In this way, they, together with the enclosing wall 4, can be fully used to achieve parallel flow of the entire working medium that is to be vaporized. Thus, the heating surfaces 8 begin in the lower area of the fluidized-bed combustion chamber 3, essentially at the combustion chamber base or at the funnel lower edge 4.1 in a combustion chamber 3 having a funnel 6 (FIG. 2) and a central position of the heating surfaces 8 within the combustion chamber 3 or on the funnel upper edge 24 in a combustion chamber 3 having two funnels 7 (FIG. 3) as well as a centered arrangement of the heating surfaces, and it terminates [sic: they terminate] in the upper area of the fluidized-bed chamber 3 essentially at the combustion chamber cover 4.3. In order to attach the individual heating surfaces 8, said surfaces may, for example, be welded together with the combustion chamber base 4.1 or the upper edge of the funnel 24 and the combustion chamber cover 4.3. If more than two funnels are to be provided in the lower area of the combustion chamber 3, the heating surfaces 8 can be integrated into the design in the logically corresponding manner.

The parallel feeding of the heating surfaces as well as of the enclosing wall 4 is carried out by collectors (not shown) by means of which the working medium that is to be vaporized is fed from below to the aforesaid heating surfaces. If the heating surfaces 8 with a combustion chamber 3 having two funnels 7 as shown in FIG. 3 do not begin until the upper edge of the funnel or at the yoke of the funnel 24, said heating surfaces 8 can be supplied with working medium via the funnel enclosing walls 4. A separate parallel feeding of the heating surfaces 8 is also possible.

The heating surfaces 8 may be heated on one or two sides. In the case of heating surfaces that are heated on two sides or in the case of bulkhead heating surfaces 8, it is advantageous to configure the heating surfaces 8 with tubes 9 that have internal ribs in order to ensure reliable cooling of the tube 9 in the partial load range of the continuous steam generator 1 and in order to prevent the boiling crises or DNBs (departures from nucleate boiling) and drying or dry out in the evaporator tube, something which could occur as a result of the additional heating of the heating surface 8 from both sides.

Figure 6:
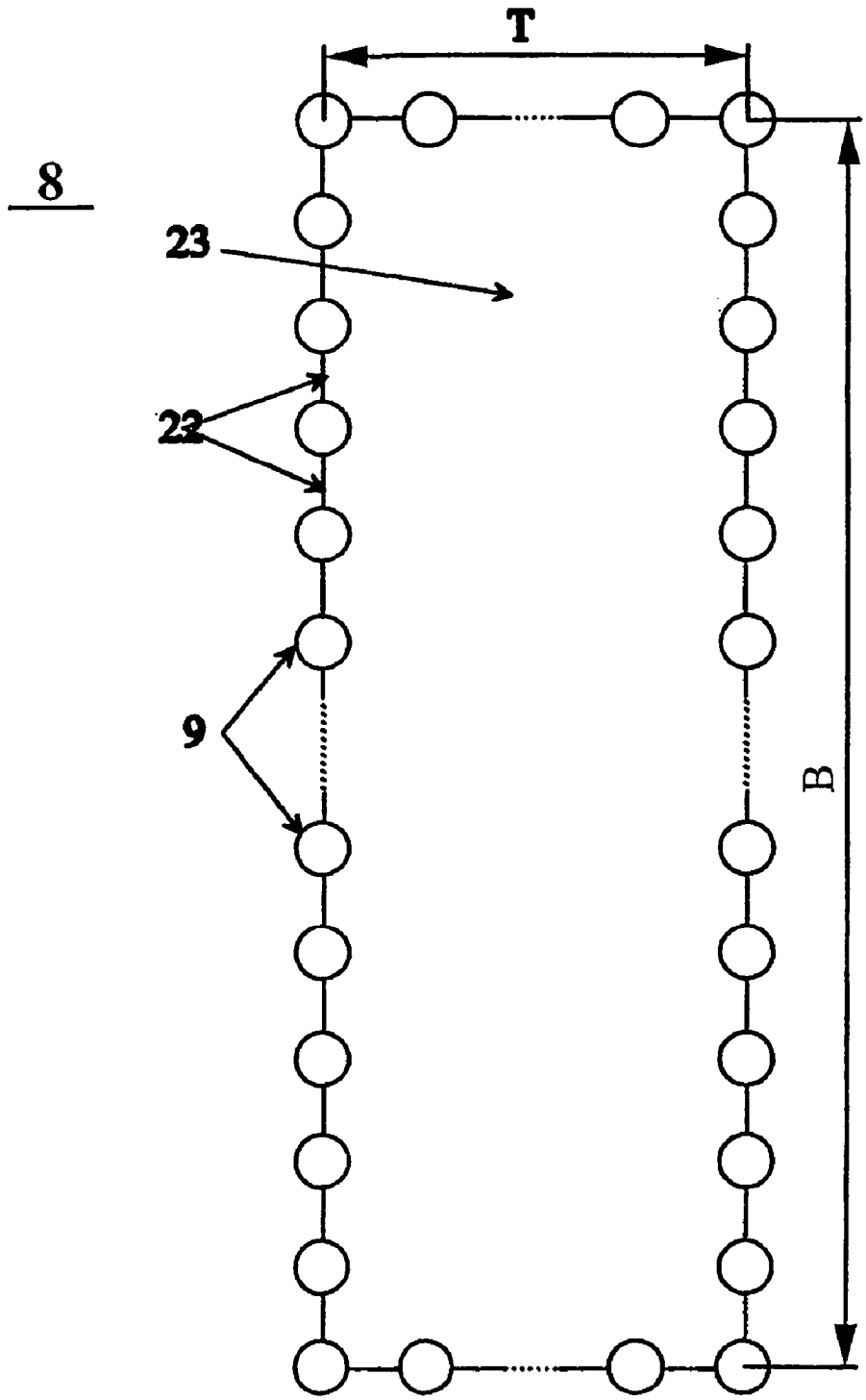

One advantageous embodiment of the solution in accordance with the invention provides for heating the heating surfaces 8 disposed inside the fluidized-bed combustion chamber 3 on one side. FIG. 6 shows a preferred embodiment of a heating surface 8 heated on one side. This heating surface 8 comprised an inner space 23 on the periphery side, and it is designed in a box shape, which is why the heating surface 8 is also called a box-shaped heating surface or a box bulkhead(s) 8 in the further description. FIG. 6 shows a preferred embodiment of the box-shaped heating surface 8 having a rectangular cross section. The box bulkhead 8 of FIG. 6 has four side walls consisting of welded membrane tube walls that are welded together at the corners, and the membrane tube walls are formed of tubes 9 and webs 22. This results in a box having a tube-web-tube design or combination that is welded together to be gas tight. Instead of the rectangular design of the box-shaped heating surface 8 shown on the cross-sectional side in FIG. 6, said heating surface can also be designed with a different cross section—for example, it can be n-cornered (at least three-cornered), round, etc. In other words, in this case the inner space 23 that is enclosed by the box-shaped heating surface 8 has an n-cornered or round cross section.

Because of the vertical arrangement of the heating surfaces 8 and thus also of the tubes 9 as well as the vertical tubes 5 of the enclosing walls 4, the tubes 5, 9 provide as few possible locations for corrosive attack as possible to the upward flowing stream of gas and particles that is present in the combustion chamber 3. In order to protect the tubes 5, 9 in the lower area of the combustion chamber or in the funnel area 6, 7 from the high transverse or turbulence flows of the stream of gas and particles in the fluidized-bed, said tubes are provided with a fire-proof covering 25.

Figure 7:
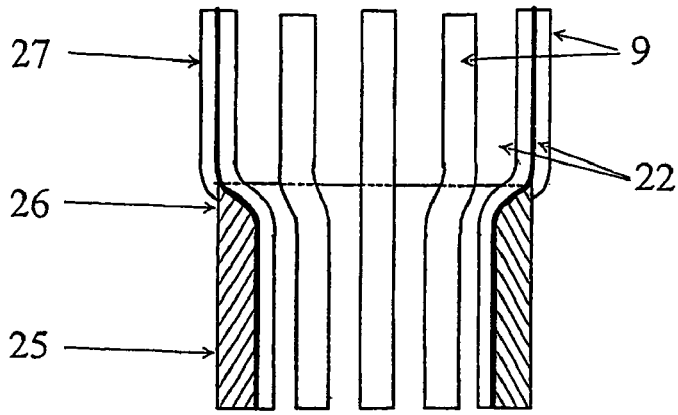
Figure 8:
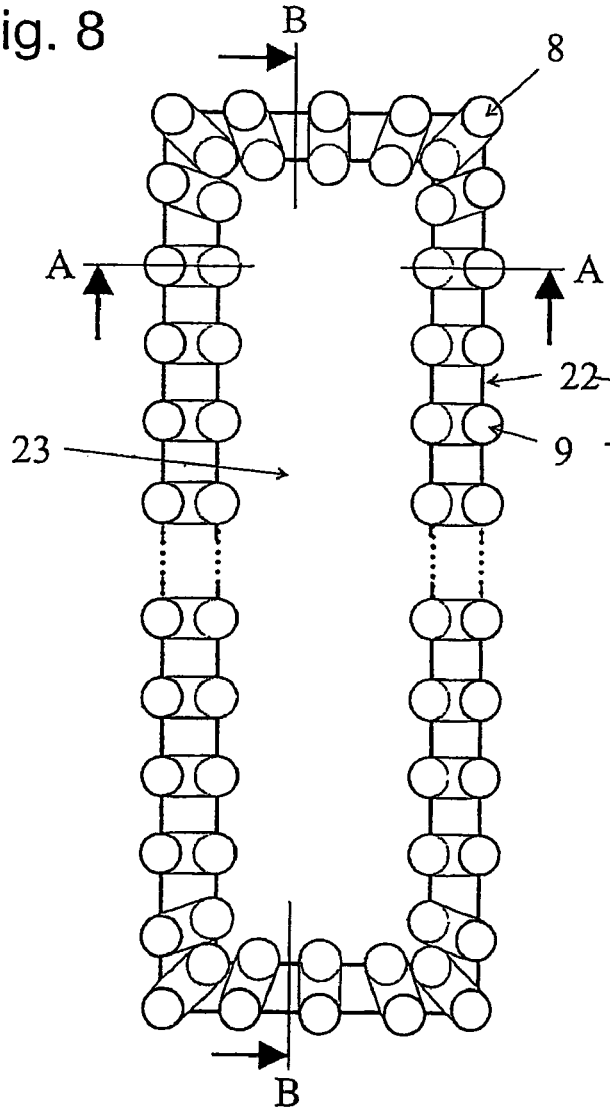
Figure 9:
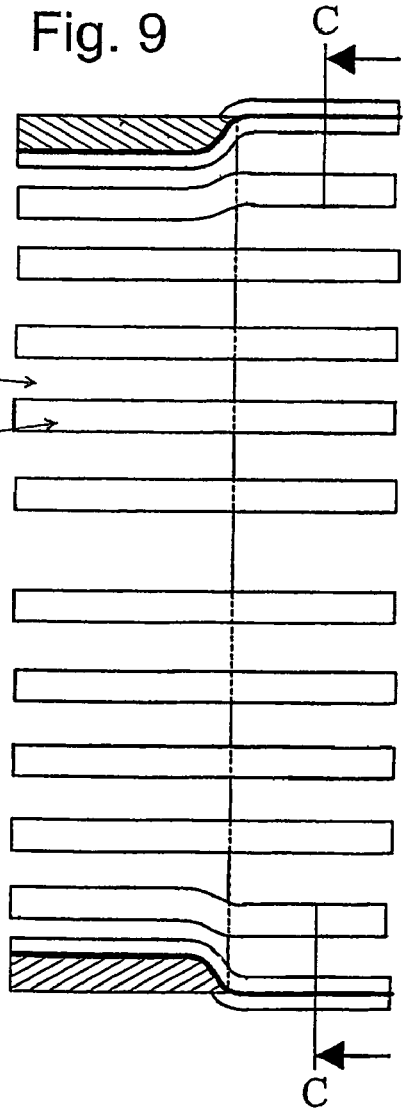

A preferred embodiment of the invention in FIGS. 7 to 9 provides the following: The tubes 9 of the heating surface 8, which is provided with a fire-proof covering 25, and which is located in the combustion chamber funnel area 6, 7, are bent inward in the transition area 26 between the covered and the non-covered heating surface area 27 and in the area of the inner space 23, and the front edges of the fireproof covering 25 and of the non-covered areas 27 of the heating surfaces 8 are configured in a vertical direction aligned with each other. This measure prevents erosion attack points to form in the transition area 26 on the tubes 9 for turbulent flows of the gas and particle stream.

As a result of the fireproof covering 25 of the tubes 5, 9 in the funnel area 6, 7 the lengths of the tubes 5, 9 are essentially equally heated within the combustion chamber 3.

The box-shaped heating surfaces 8, that extend across a length L and across their cross-section across a width B and a depth T, and in the preferred embodiment they have dimensions of approximately 1.4 to 4.0 m across the width B, approximately 0.1 to 1.0 m across the depth T, and approximately 20 to 50 m across the length L. This also permits the combustion chambers 3 of larger continuous steam generators 1 to be properly equipped.

The tubes 9 used for the box-shaped heating surfaces 8 possess diameters between 20 mm and 70 mm in a preferred embodiment. The manufacturing of the box-shaped heating surfaces 8 can be accomplished using the same conventional materials and manufacturing techniques that are used to manufacture steam generators.

What is claimed is:

1. A continuous steam generator having a circulating atmospheric fluidized-bed firing system comprising:

a fluidized-bed combustion chamber, in which the fluidized-bed combustion chamber is essentially defined on all sides by enclosing walls, having gas-tight tubular walls essentially comprising vertical heat exchange tubes and in the lower area at least one funnel, and the fluidized-bed combustion chamber is embodied with at least one essentially vertically disposed heating surface equipped with vertical heat exchange tubes, whereby the heating surface is comprised of a welded tube-web-tube combination, and whereby the tubes of the enclosing walls and the heating surface have a water/steam working medium passing through them, wherein all tubes of the enclosing walls and the heating surface are configured as an evaporator heating surface, and they are connected in parallel so that all of the working medium that is to be evaporated can pass through them, all tubes of the enclosing walls are configured with a tube surface area that is smooth on the inside, and the heating surface extends between the bottom of the combustion chamber or the top of the funnel edge and the combustion chamber cover; and a separator disposed externally to the fluidized-bed combustion chamber, the separator having an inlet in fluid communication with an upper portion of the fluidized-bed combustion chamber and an outlet in fluid communication with a lower portion of the fluidized-bed combustion chamber, the separator receiving a flue gas from the fluidized-bed combustion chamber, removing solids entrained in the flue gas, and returning the solids to the fluidized-bed combustion chamber;

whereby heat produced by combustion is transferred from a fluidized-bed, comprising a mixture of gas and entrained solids, to substantially the entire heating surface and the enclosing walls.

2. The continuous steam generator of claim 1, wherein the flow of working media through the tubes of the enclosing walls and of the heating surface is accomplished without the aid of intermediate collectors.

3. The continuous steam generator of claim 2, wherein the heating surface can be heated on both sides.

4. The continuous steam generator of claim 3, wherein the inner surfaces of the tubes of the heating surface have an internal ribbing.

5. The continuous steam generator of claim 2, wherein the heating surface is configured so that it can be heated from one side.

6. The continuous steam generator of claim 5, wherein the inner surfaces of the tubes of the heating surface have a smooth surface.

7. The continuous steam generator of claim 2, wherein the cross section of the box-shaped heating surface is configured to have at least three-corners or to be round.

8. The continuous steam generator of claim 1, wherein the heating surface can be heated on both sides.

9. The continuous steam generator of claim 8, wherein the inner surfaces of the tubes of the heating surface have an internal ribbing.

10. The continuous steam generator of claim 9, wherein the cross section of the box-shaped heating surface is configured to have at least three-corners or to be round.

11. The continuous steam generator of claim 8, wherein the cross section of the box-shaped heating surface is configured to have at least three-corners or to be round.

12. The continuous steam generator of claim 1, wherein the heating surface is configured so that it can be heated from one side.

13. The continuous steam generator of claim 12, wherein the inner surfaces of the tubes of the heating surface have a smooth surface.

14. The continuous steam generator of claim 13, wherein the heating surface has a box-shaped cross section with a width and a depth and on the peripheral side comprises an inner space that is closed around its circumference.

15. The continuous steam generator of claim 12, wherein the heating surface has a box-shaped cross section with a width and a depth and on the peripheral side comprises an inner space that is closed around its circumference.

16. The continuous steam generator of claim 15, wherein the tubes of the box-shaped heating surface, which are provided with a fireproof covering in the combustion chamber funnel area are bent out into the area of the inner space in the transition area between the covered and non-covered heating surface area, and the front edges of the fireproof covering and of the non-covered area of the heating surface are configured so that they align in the vertical direction.

17. The continuous steam generator of claim 1, wherein the cross section of the box-shaped heating surface is configured to have at least three-corners or to be round.

18. The continuous steam generator of claim 1, wherein the cross section of the box-shaped heating surface is configured to be rectangular.

19. The continuous heat generator of claim 1, wherein the tubes of the enclosing walls essentially have equal heated lengths.

20. The continuous heat generator of claim 1, wherein the tubes of the heating surface essentially have the same heated length as the tubes of the surrounding walls.

* * * * *

US007331313C1

(12) INTER PARTES REEXAMINATION CERTIFICATE (890th)

United States Patent
Weissinger et al.

(10) Number: US 7,331,313 C1
(45) Certificate Issued: Jun. 12, 2014

(54) CONTINUOUS STEAM GENERATOR WITH CIRCULATING ATMOSPHERIC FLUIDISED-BED COMBUSTION

(75) Inventors: Gerhard Weissinger, Köngen (DE); Georg-Nikolaus Stamatelopoulos, Stuttgart (DE); Günter Trautmann, Winnenden (DE)

(73) Assignee: Alstom Technology Ltd, Baden (CH)

Reexamination Request:
No. 95/001,941, Mar. 16, 2012

Reexamination Certificate for:

| | |
|---|---|
| Patent No.: | **7,331,313** |
| Issued: | **Feb. 19, 2008** |
| Appl. No.: | **10/535,810** |
| Filed: | **Oct. 11, 2005** |

(21) Appl. No.: 95/001,941

(22) PCT Filed: Nov. 18, 2003

(86) PCT No.: PCT/DE03/03808

§ 371 (c)(1),
(2), (4) Date: Oct. 11, 2005

(87) PCT Pub. No.: WO2004/048848

PCT Pub. Date: Jun. 10, 2004

(30) Foreign Application Priority Data

Nov. 22, 2002 (DE) ..... 102 54 780

(51) Int. Cl.
*F22D 1/08* (2006.01)
*F22D 1/04* (2006.01)

(52) U.S. Cl.
USPC ..... 122/406.1; 122/4 D

(58) Field of Classification Search
None
See application file for complete search history.

(56) References Cited

To view the complete listing of prior art documents cited during the proceeding for Reexamination Control Number 95/001,941, please refer to the USPTO's public Patent Application Information Retrieval (PAIR) system under the Display References tab.

*Primary Examiner* — William Doerrler

(57) ABSTRACT

A continuous steam generator with a circulating atmospheric fludized-bed chamber is defined by encircling walls essentially on all sides, comprised of gas-permeable tubular walls provided with essentially vertical tubes, and comprises at least one funnel in its lower region. The turbulence combustion chamber has at one essentially vertically arranged heating surface provided with vertical tubes, said heating surface comprises of a welded tube-web-tube combination, and a water/steam working medium flows through the tubes of the encircling walls and the heating surface. All of the tubes of the encircling walls and the heating surface are embodied as evaporator heating surfaces and are mounted in parallel for the circulation of the entire working medium to be evaporated. In addition, all of the tubes of the encircling walls have an inner smooth surface, and the heating surface extends between the bottom of the combustion chamber or the upper edge of the funnel, and the top of the combustion chamber.

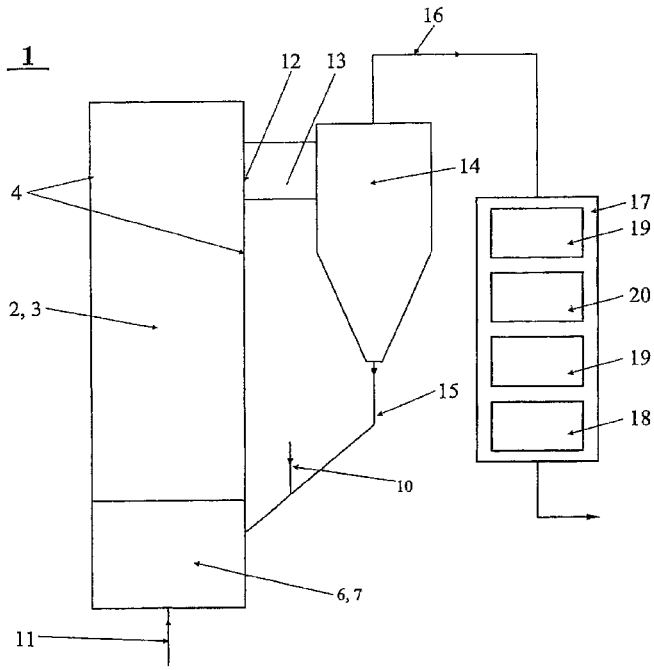

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-20 are cancelled.

* * * * *